US008209812B1

(12) United States Patent
Dondurur et al.

(10) Patent No.: US 8,209,812 B1
(45) Date of Patent: Jul. 3, 2012

(54) GRILL CLEANING BRUSH

(75) Inventors: Mehmet Dondurur, Dhahran (SA); Ahmet Z. Sahin, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 13/031,575

(22) Filed: Feb. 21, 2011

(51) Int. Cl.
*A47L 17/00* (2006.01)
*B08B 1/00* (2006.01)

(52) U.S. Cl. ..... 15/229.11; 15/111; 15/160; 134/6

(58) Field of Classification Search ..... 15/229.11, 15/111, 160; 134/6
See application file for complete search history.

(56) References Cited

U.S. PATENT DOCUMENTS

| | | | | |
|---|---|---|---|---|
| 638,305 | A | 12/1899 | Wightman | |
| 1,878,323 | A | 9/1932 | Quist | |
| 4,286,349 | A | 9/1981 | Dugrenier | |
| 5,301,472 | A | 4/1994 | Lyng | |
| 5,947,806 | A | 9/1999 | Rhoads | |
| 6,023,810 | A * | 2/2000 | Gessert | 15/229.13 |
| 6,817,932 | B2 | 11/2004 | Furey | |
| 6,916,382 | B1 * | 7/2005 | Aldredge | 134/6 |
| 7,168,124 | B2 | 1/2007 | Dalias | |
| D567,510 | S | 4/2008 | Tuli | |
| D601,347 | S | 10/2009 | Wales | |
| 2003/0028985 | A1 * | 2/2003 | Prodoehl et al. | 15/118 |
| 2005/0160544 | A1 | 7/2005 | Geller | |
| 2009/0188061 | A1 | 7/2009 | Cybulski et al. | |

* cited by examiner

*Primary Examiner* — Monica Carter
*Assistant Examiner* — Stephanie Newton
(74) *Attorney, Agent, or Firm* — Richard C. Litman

(57) ABSTRACT

The grill cleaning brush provides for the cleaning of accumulated deposits from the sides of grill grate bars, along with the simultaneous cleaning of collected grease, oil, fat and other liquids or semi-liquids that have accumulated on the grill grate. The grill cleaning brush includes a base having opposed upper and lower surfaces, a gripping handle mounted on the upper surface of the base, and a cleaning layer attached to the lower surface of the base. The cleaning layer includes both a wire scrubber and a grease absorbent pad embedded within the wire scrubber. Preferably, the wire scrubber is provided as first and second wire scrubber pads attached to the lower surface of the base, the grease absorbent pad being sandwiched therebetween. The grease absorbent pad may be formed from cotton, paper, a combination of the two, or the like.

13 Claims, 5 Drawing Sheets

GRILL CLEANING BRUSH

BACKGROUND OF THE INVENTION

1. Field of the Invention

The present invention relates to cooking appliances and appliances for outdoor grills, and particularly to a grill cleaning brush for cleaning grill grates, such as the grates of barbecue grills and the like.

2. Description of the Related Art

The use of brushes and scrapers for the cleaning of grill grates of gas and charcoal grills is well known. Typically, grill brushes have a head portion and a handle portion. Such grill brushes usually have metallic bristles, which are generally all of a constant length and form a generally planar abrasive surface. This bristle configuration permits the top surface of the grill to be scrubbed with the grill brush, but does not facilitate the cleaning of the sides of the grill grate bars. Additionally, such cleaning is purely of the abrasive type and does not remove grease, oil or other fluids that may be on the grill.

It is therefore difficult to remove accumulated deposits from the sides of the grate bars without significant effort, and further, it is impossible to clean grease, oil, fat and other liquids or semi-liquids that have accumulated on the grill grate.

Thus, a grill cleaning brush solving the aforementioned problems is desired.

SUMMARY OF THE INVENTION

The grill cleaning brush provides for the cleaning of accumulated deposits from the sides of grill grate bars, along with the simultaneous cleaning of collected grease, oil, fat and other liquids or semi-liquids that have accumulated on the grill grate. The grill cleaning brush includes a base having opposed upper and lower surfaces, a gripping handle mounted to the upper surface of the base, and a cleaning layer mounted to the lower surface of the base. The cleaning layer includes both a wire scrubber and a grease absorbent pad embedded within the wire scrubber. Preferably, the wire scrubber is provided as first and second wire scrubber pads, each attached to the lower surface of the base and the grease absorbent pad being sandwiched therebetween.

The wire scrubber pads may be in the form of continuous pads formed from a wire scrubbing material, or each may be formed from at least one substantially cylindrical roll of wire scrubbing material. The grease absorbent pad may be formed from cotton, paper, a combination of the two, or the like.

Alternatively, a pair of laterally opposed sidewalls may project downwardly from opposed side edges of the lower surface of the base. An axle is rotatably attached to the sidewalls and extends therebetween. The cleaning layer is mounted about the axle. The axle is driven by an attached motor for selective driven rotation of the cleaning layer, thereby providing for powered scrubbing of the grill grate.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
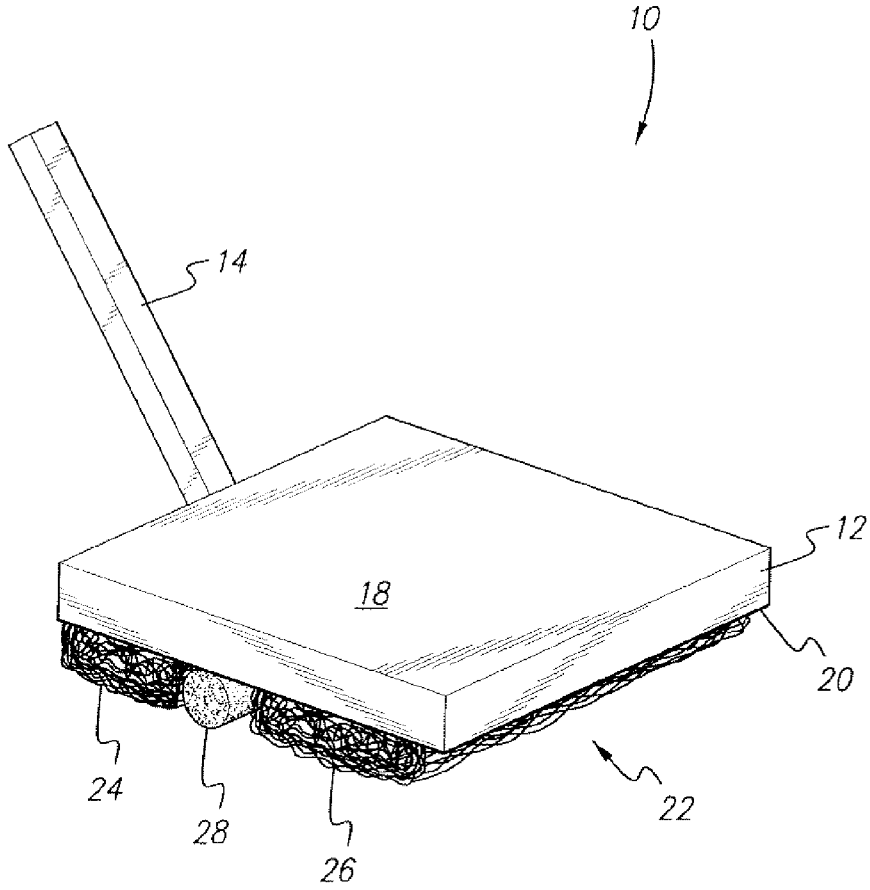
FIG. 1A is a perspective view of a grill cleaning brush according to the present invention.

The grill cleaning brush 10 provides for the cleaning of accumulated deposits from the sides of grill grate bars, along with the simultaneous cleaning of collected grease, oil, fat and other liquids or semi-liquids that have accumulated on the grill grate. As shown in FIG. 1A, the grill cleaning brush 10 includes a base 12 having opposed upper and lower surfaces, 18, 20, respectively, a gripping handle 14 mounted to the upper surface 18 of base 12, and a cleaning layer 22 attached to the lower surface 20 of base 12.

Figure 1B:
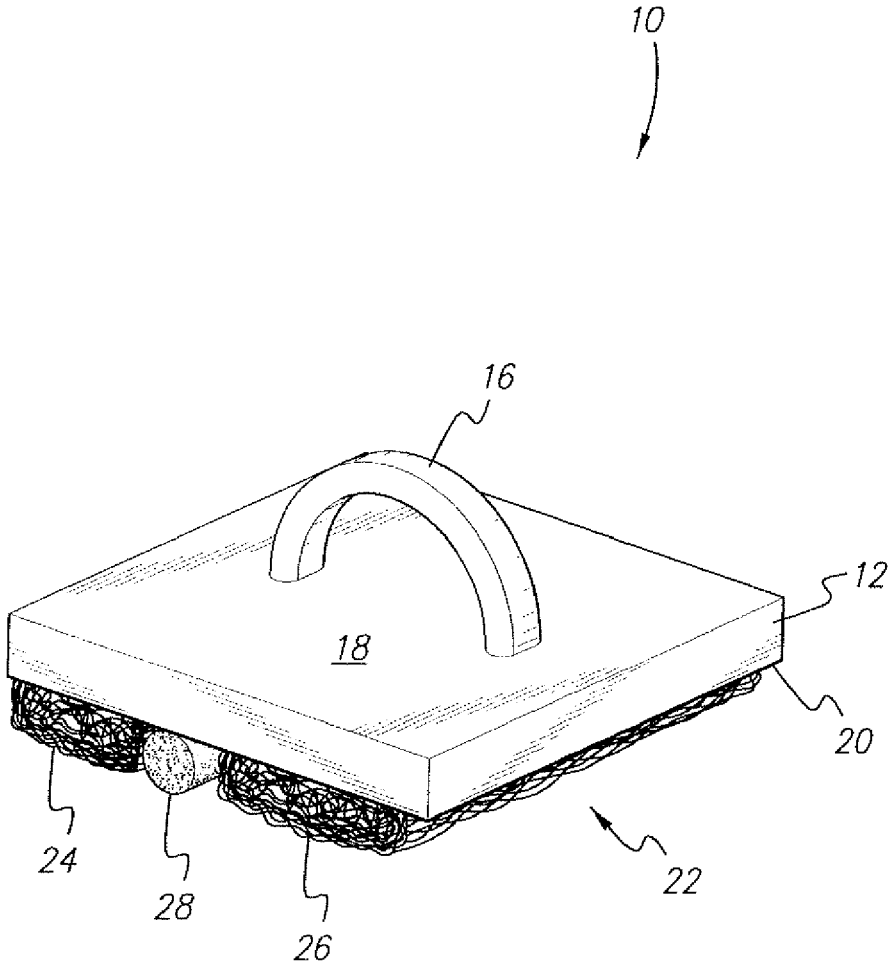
FIG. 1B is a perspective view of an alternative embodiment of a grill cleaning brush according to the present invention.

In FIG. 1A, the handle 14 is shown as being elongated and being angled with respect to upper surface 18 of base 12. It should be understood that any desired type of handle may be fixed to base 12. FIG. 1B illustrates an alternative example, the brush 10 having an inverted, U-shaped handle 16 disposed substantially centrally on the upper surface 18. Further, although shown as being substantially rectangular in the drawings, it should be understood that the base 12 may have any desired dimensions or configuration. Exemplary dimensions for the base 12 include a length of approximately three inches, a width of approximately two inches, and a thickness of approximately one-half of an inch. The base 12 may be formed from metal, wood, plastic or the like.

The cleaning layer 22 includes both a wire scrubber formed from copper wire, copper wool, steel wire, steel wool, combinations thereof or the like, and also a grease absorbent pad 28 embedded within the wire scrubber. As shown in FIGS. 1A and 1B, the wire scrubber may be provided as first and second wire scrubber pads 24, 26, respectively, that are attached to the lower surface 20 of the base 12, and the grease absorbent pad 28 may be sandwiched therebetween. The pads 24, 26 are configured to match the shape of the base 12. In the example of FIGS. 1A and 1B, in which the base 12 is rectangular, each pad 24, 26 also is substantially rectangular, the pads 24, 26 and the grease absorbent pad 28 substantially covering the entire lower surface 20.

Figure 2A:
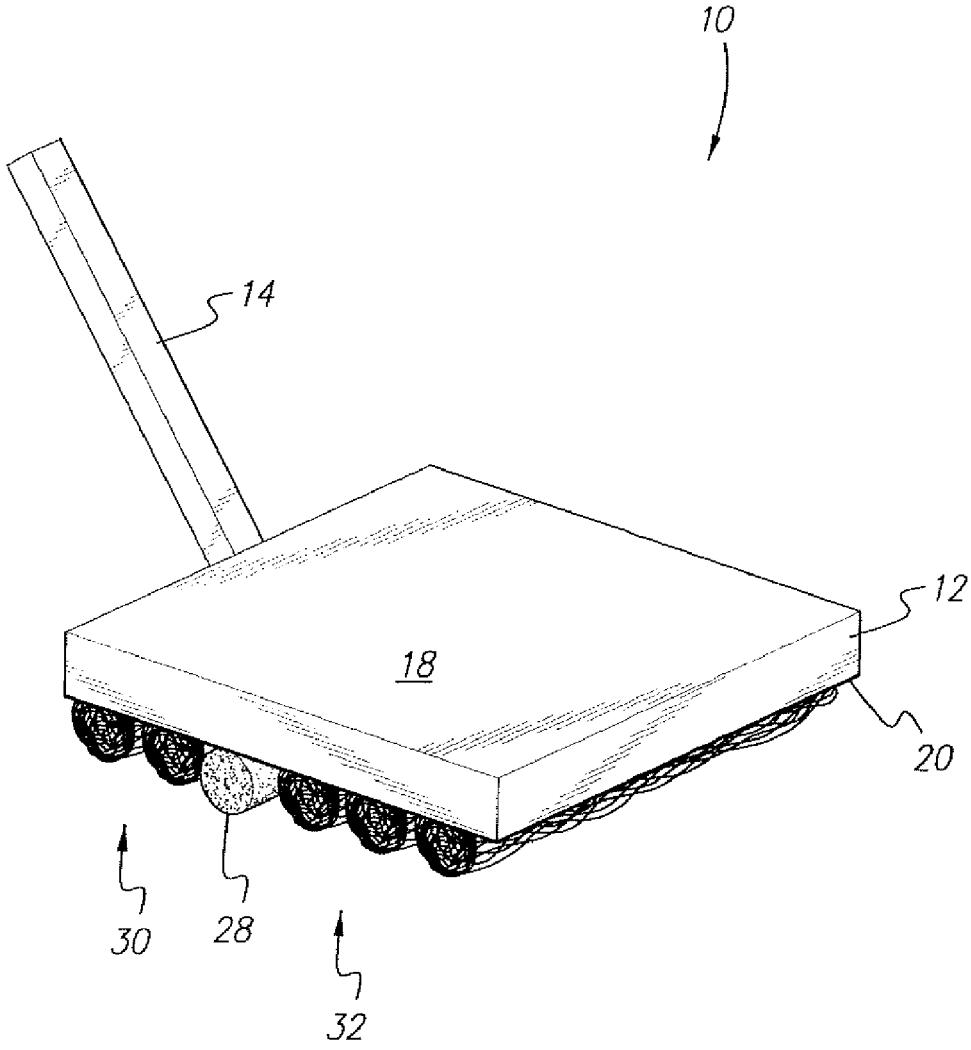
FIG. 2A is a perspective view of another alternative embodiment of a grill cleaning brush according to the present invention.
Figure 2B:
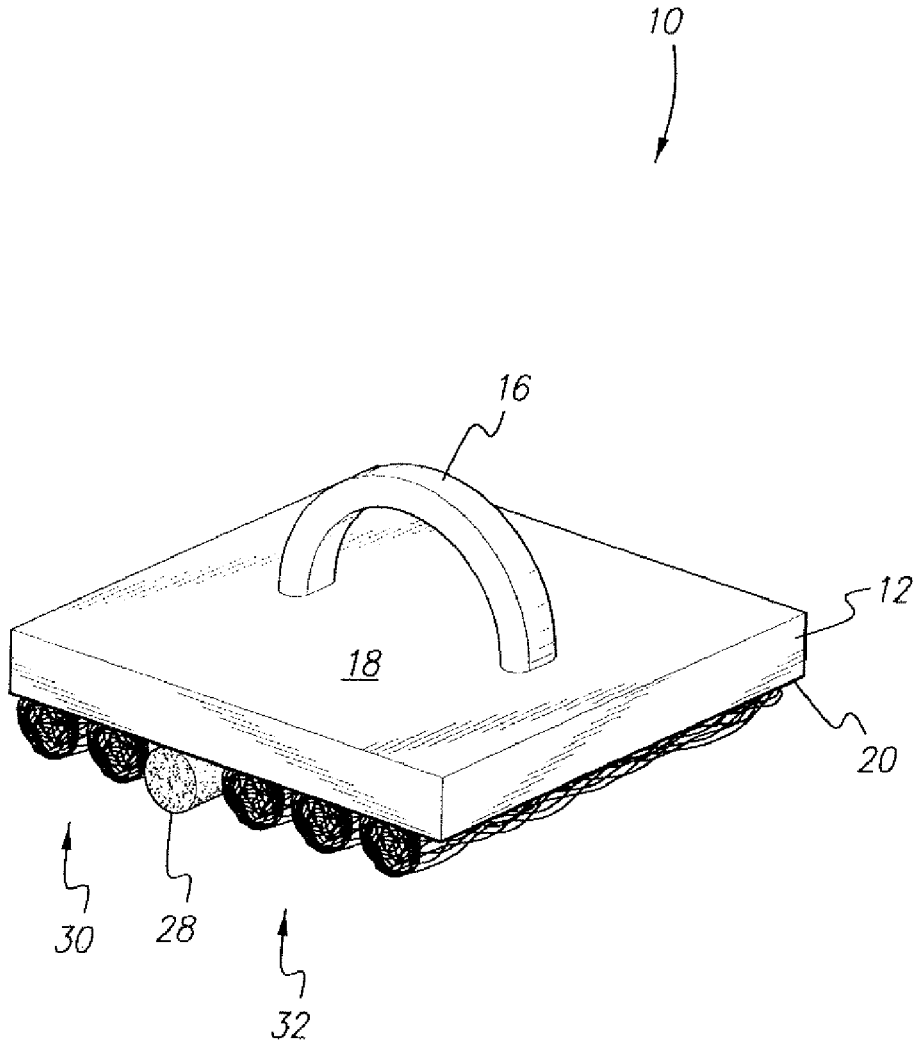
FIG. 2B is a perspective view of still an alternative embodiment of a grill cleaning brush according to the present invention.

In the alternative embodiments of FIGS. 2A and 2B, the grill cleaning brushes are substantially similar to those shown in FIGS. 1A and 1B, respectively, but the rectangular pads 24, 26 are each replaced by at least one substantially cylindrical roll of wire scrubbing material. First pad 24 is replaced by a pair of cylindrical roils 30 and the second pad 26 is replaced by three such cylindrical rolls 32 in both FIGS. 2A and 2B, although it should be understood that any desired number of wire scrubbing rolls may be used. The grease absorbent pad 28 may be formed from cotton, paper, a combination of the two, or the like. The grease absorbent pad 28 has a thickness matching that of the pads 24, 26 or the rolls 30, 32, and using the exemplary dimensions given above, the cross-sectional length (measured along the length of the base 12) is approximately one-quarter of an inch. Preferably, the wire scrubbing material in pads 24, 26 and rolls 30, 32 is a combination of both rough and soft graded wire scrubber material.

Figure 3:
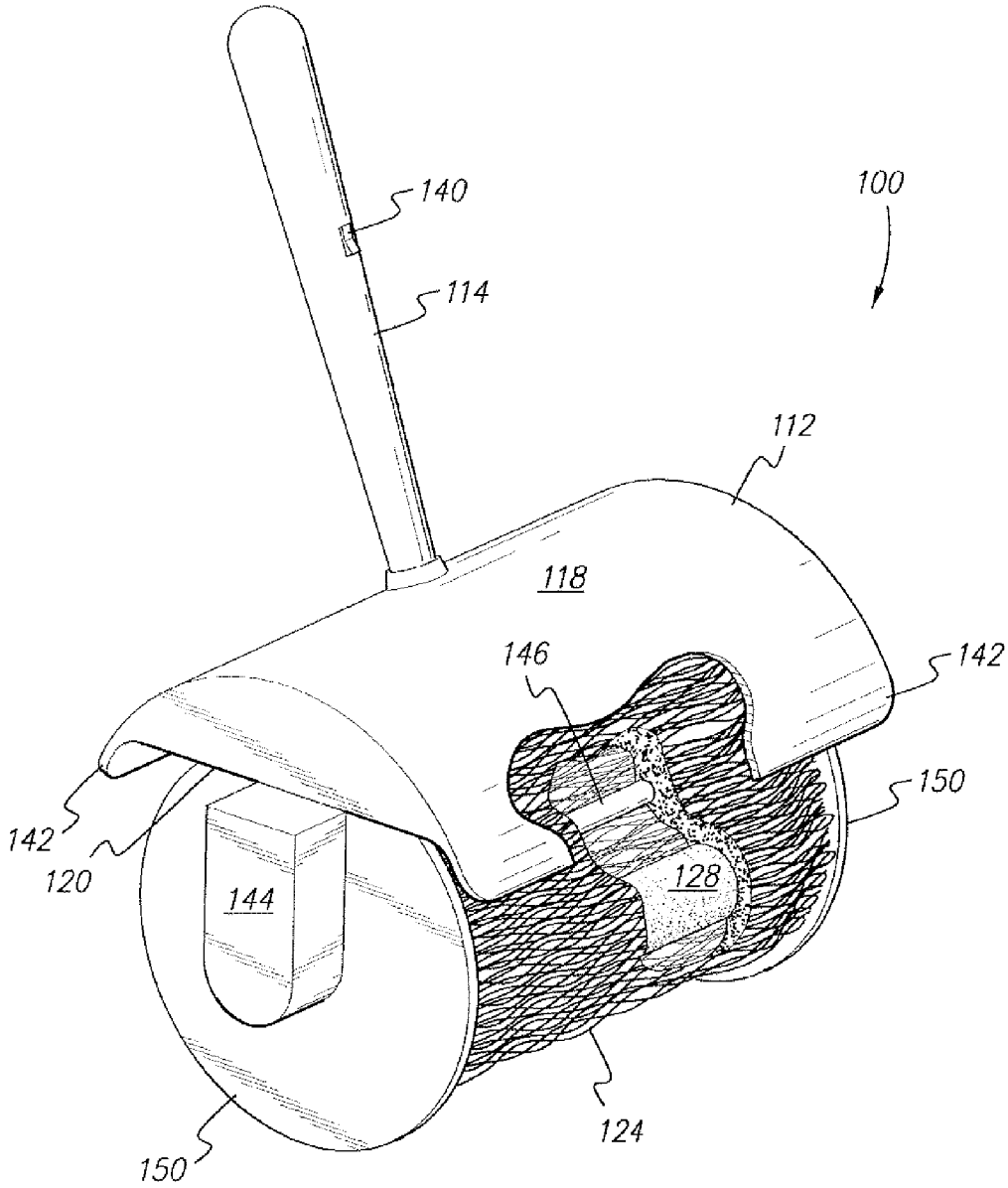
FIG. 3 is a perspective view of yet another alternative embodiment of a grill cleaning brush according to the present invention.

In the alternative embodiment of FIG. 3, the brush 100 also includes a base 112 and a handle 114 secured to an upper surface 118 thereof. A pair of laterally opposed sidewalls 150 project downwardly from opposed side edges of the lower surface 120 of the base 112. An axle 146 is rotatably attached to the sidewalls 150, and a grease absorbent pad 128 is mounted on the axle and embedded within a cylindrical roll of wire scrubbing material 124, which is wrapped around axle 146. The grease absorbent pad 128 is formed from a similar material as that described above with regard to the pad 28, and the wire scrubbing material 124 is similar to that described above with regard to the pads 24, 26 and rolls 30, 32.

The axle 146 is driven by an attached motor 144 for selective driven rotation of the cleaning layer for powered scrubbing of the grill grate. Motorized hand tools and the like are well known in the art. Examples of such tools are shown in U.S. Pat. Nos. 5,947,806 and 6,817,932, each of which is hereby incorporated by reference in its entirety. It should be understood that the grill cleaning brush 100 may use any suitable type of motor or other driver to selectively drive rotation of the axle 146. The motor or drive 144 may be powered by batteries or by a power cord. The motor or drive 144 is selectively actuated through user actuation of power switch 140, which is preferably provided on the handle 114. A pair of shields 142 may be fixed to the front and rear edges of the base 112 to prevent debris from being projected above the plane of the base 112.

It should be understood that the base 112 may have any desired dimensions or configuration. Exemplary dimensions for the base 112 include a length of approximately three inches and a width of approximately two inches. The axle 146 has a length of approximately three inches, matching that of the base 112, and the wire scrubbing material 124 has a radial thickness between approximately one-half of one inch and one and one-half inches.

It is to be understood that the present invention is not limited to the embodiments described above, but encompasses any and all embodiments within the scope of the following claims.

We claim:

1. A grill cleaning brush, comprising:

a base having opposed upper and lower surfaces;

a gripping handle mounted on the upper surface of the base; and a cleaning layer attached to the lower surface of the base, the cleaning layer having:

a wire scrubber;

a grease absorbent pad embedded in the wire scrubber; and an axle, said wire scrubber and said grease absorbent pad being attached to the axle.

2. The grill cleaning brush as recited in claim 1, wherein said wire scrubber comprises first and second wire scrubber pads, said grease absorbent pad being sandwiched therebetween.

3. The grill cleaning brush as recited in claim 2, wherein each said wire scrubber pad comprises at least one substantially cylindrical roll of wire scrubbing material.

4. The grill cleaning brush as recited in claim 1, wherein said grease absorbent pad is formed from at least one material selected from the group consisting of paper and cotton.

5. The grill cleaning brush as recited in claim 1, further comprising a pair of laterally opposed sidewalls projecting downwardly from opposed side edges of the lower surface of said base, the axle being rotatably mounted on the sidewalls.

6. The grill cleaning brush as recited in claim 5, further comprising means for selectively driving rotation of the axle.

7. The grill cleaning brush as recited in claim 6, wherein said means for selectively driving rotation of the axle comprises a motor.

8. The grill cleaning brush as recited in claim 7, wherein said grease absorbent pad is formed from at least one material selected from the group consisting of paper and cotton.

9. A grill cleaning brush, comprising:

a base having opposed upper and lower surfaces;

a gripping handle attached to the upper surface of the base;

a wire scrubber;

a grease absorbent pad embedded in the wire scrubber; and an axle rotatably mounted below the base, the wire scrubber and the grease absorbent pad being attached to the axle.

10. The grill cleaning brush as recited in claim 9, further comprising a pair of laterally opposed sidewalls projecting downwardly from opposed side edges of the lower surface of said base, the axle being rotatably mounted on the sidewalls.

11. The grill cleaning brush as recited in claim 10, further comprising means for selectively driving rotation of the axle.

12. The grill cleaning brush as recited in claim 11, wherein said means for selectively driving rotation of the axle comprises a motor.

13. The grill cleaning brush as recited in claim 12, wherein said grease absorbent pad is formed from at least one material selected from the group consisting of paper and cotton.

* * * * *